US006112380A

United States Patent [19]

Dolan et al.

[11] Patent Number: 6,112,380

[45] Date of Patent: Sep. 5, 2000

[54] NOVELTY LACE HAVING EXPANDABLE AGLETS

[75] Inventors: Dana Dolan, East Hampton, N.Y.; Jose R. Matos, Plano, Tex.

[73] Assignee: Lulirama International, Inc., Dallas, Tex.

[21] Appl. No.: 09/138,067

[22] Filed: Aug. 21, 1998

Related U.S. Application Data

[63] Continuation-in-part of application No. 08/797,093, Feb. 7, 1997, Pat. No. 5,806,153.

[51] Int. Cl.[7] ..... A43B 3/00; A43C 1/00

[52] U.S. Cl. ..... 24/715.4; 24/712.1; 24/713; 24/715.5; 36/11.5

[58] Field of Search ..... 24/715.4, 712.1, 24/712.3, 712.9, 713, 3.13, 17 B, 17 AP, 30.5 P, 300; 40/636; 446/118, 119, 490; 36/97, 11.5

[56] References Cited

U.S. PATENT DOCUMENTS

| | | | |
|---|---|---|---|
| D. 327,568 | 7/1992 | Dutkanych | D2/316 |
| 761,963 | 6/1904 | Hiller . | |
| 1,142,199 | 6/1915 | Olson . | |
| 1,150,616 | 8/1915 | Officer . | |
| 1,172,954 | 2/1916 | Derrenberger | 24/713 |
| 1,233,863 | 7/1917 | Fry . | |
| 1,245,965 | 11/1917 | Pratt | 24/712.1 |
| 2,004,702 | 6/1935 | Luttmann, Jr. | 24/143 |
| 2,612,135 | 9/1952 | Iny | 116/170 |
| 2,650,399 | 9/1953 | Torelli | 24/117 |
| 2,952,462 | 9/1960 | Planin | 272/157 |
| 3,559,251 | 2/1971 | Wilson | 24/143 |
| 3,636,594 | 1/1972 | Faivre | 24/715.4 |
| 3,775,873 | 12/1973 | Small | 36/11.5 |
| 4,553,342 | 11/1985 | Derderian et al. | 36/97 |
| 4,561,153 | 12/1985 | Matsui | 24/16 |
| 4,935,851 | 6/1990 | Wood | 362/103 |
| 4,991,273 | 2/1991 | Huttle | 24/712.1 |
| 5,293,668 | 3/1994 | Tibiletti | 24/30.5 P |

FOREIGN PATENT DOCUMENTS

| | | |
|---|---|---|
| 200107 | 6/1923 | United Kingdom . |

*Primary Examiner*—Victor N. Sakran
*Attorney, Agent, or Firm*—Gardere & Wynne, L.L.P.; Lawrence R. Youst

[57] ABSTRACT

The invention provides laces, such as shoelaces, having affixed to them repeatedly collapsible and expandable aglets which can form 2- or 3-dimensional objects. The aglets can advantageously be passed through an eyelet thereby making it possible for them to be permanently affixed to laces during their manufacture. Thus, a user need not purchase a lace and aglets separately and attach them to each other after lacing an article such as a shoe.

22 Claims, 3 Drawing Sheets

NOVELTY LACE HAVING EXPANDABLE AGLETS

CROSS-REFERENCE TO RELATED APPLICATIONS

This application is a continuation-in-part of U.S. patent application Ser. No. 08/797,093 filed Feb. 7, 1997 which is now U.S. Pat. No. 5,806,153.

FIELD OF THE INVENTION

The present invention relates generally to laces, and more specifically, to laces having affixed thereto collapsible and expandable aglets forming 3-dimensional objects.

BACKGROUND OF THE INVENTION

Laces are generally used in shoes, garments, leather accessories, and other such items requiring facile adjustable tying and release means. Laces with fanciful decorations are typically used to enhance the appearance and aesthetic appeal of articles, such as shoes, employing them. New, more decorative laces are continually developed and successfully marketed reflecting an ever present need and demand for them.

Laces, in particular shoelaces, have been adorned in a variety ways as by coloration, printing of pictures and or words thereon, inclusion of light emitting devices therein (U.S. Pat. No. 4,935,851 to Wood), construction with different synthetic, natural and metallic fibers, inclusion of coils or springs therein (U.S. Pat. No. DES 327,568 to Dutkanych) and the like.

Shoelaces have also be adorned with a variety of 2- and 3-dimensional objects. U.S. Pat. No. 2,650,399 to Torelli discloses knot retainers through which shoelaces are laced to aid in maintaining shoelaces tied. U.S. Pat. No. 4,991,273 to Huttle discloses elastic shoelaces with decorative fastenings through which the shoelaces are laced.

Fixture of 3-dimensional objects, i.e. aglets, onto lace ends is also known. The Iny patent (U.S. Pat. No. 2,612,135) discloses miniature bells as aglets which are affixed onto the ends of shoelaces once the laces have been laced through the eyelets of a shoe. The bells are snapped onto the shoelace ends by employing a ball & socket type configuration.

Wilson (U.S. Pat. No. 3,559,251) discloses a variety of 3-dimensional objects affixed to the ends of shoelaces. These aglets employ another ball & socket type configuration for attachment purposes.

Thus, the art establishes the need for improved laces having aglets that form 2- or 3-dimensional objects; however, none of the known laces have aglets that are collapsible, expandable and sufficiently small to fit through an eyelet of a shoe, and all of the known aglets which are 3-dimensional objects require assembly subsequent to lacing of a shoe.

Absorbent materials, such as natural sponge or poly(vinyl alcohol) based sponge, are used as toys. Such materials expand when placed in water to form a preconfigured object. For example, a sponge in the shape of a duck can be collapsed, and when immersed in water, the sponge will expand to form the preconfigured duck. When the sponge toy dries, it will shrink only a small degree and generally remain approximately the same size wet or dry. Although these sponge toys do not generally completely collapse to substantially their original size after drying, they can generally be collapsed either manually or mechanically after they have been expanded.

U.S. Pat. No. 2,952,462 to Planin discloses machine collapsed sponge toys that can be placed in water and expanded to form preconfigured, generally flattened 2- or 3-dimensional objects such as puzzles, animals, balls and cylinders.

There is no teaching or suggestion in the art of the invention as described and claimed herein. Due to the ever present demand for shoelace novelties, there remains a need for laces providing new decorative features.

SUMMARY OF THE INVENTION

The present invention overcomes the disadvantages of known laces having an aglet which forms a 2- or 3-dimensional object and also includes novel and particularly advantageous embodiments. Thus, the present invention is generally directed to a lace having a repeatedly collapsible and expandable aglet affixed thereto, which aglet can be laced through the eyelet of a shoe, article of clothing or other article. The 2- or 3-dimensional objects formed by the aglet of the invention can be shaped as essentially any person, place or thing such as, by way of example, a building, animal, food, toy, weapon, machinery, caricature, fanciful figure, logo, letter, text, spaceship, and air, land or water borne vehicle, and the like.

One particularly advantageous feature of the collapsible and expandable aglets herein is that they can be permanently attached to a lace prior to lacing through the eyelets of an article. This feature facilitates use and adds value to laces which up to now have ornamentation limited in size to that which approximates the hole of an eyelet.

Another particularly advantageous feature of the collapsible and expandable aglets herein is that they arc repeatedly collapsible and expandable. For example, when water expandable material is disposed within the aglet of the invention, the material can be repeatedly hydrated (expanded) and dehydrated (collapsed). Depending upon the characteristics of the material used, the aglets can be made to collapse either partially or to substantially their original size as desired without the need of a machine. No other known aglets have this unique feature.

In one aspect, the invention provides a lace having an ornamental or decorative object affixed thereto. Thus, one embodiment of the invention is a lace having, affixed thereto, a repeatedly collapsible and expandable aglet comprising a shell and a repeatedly collapsible and expandable material disposed within the shell, said aglet being capable of forming an expanded 2- or 3-dimensional object and of being laced through an eyelet.

The shell can comprise water permeable or water impermeable materials, and the lace can serve as a wicking agent to bring a solvent or water into the aglet. The collapsible and expandable material in the aglet can be repeatedly collapsed and expanded by without the need of a machine. The collapsible and expandable material can be water expandable and collapsing agent collapsible.

In another aspect, the invention provides a lace accessory, such as an aglet, which is repeatedly collapsible and expandable. Thus, in another embodiment, the invention is a repeatedly collapsible and expandable lace accessory capable of forming an expanded 2- or 3-dimensional object and of being laced through an eyelet, said lace accessory comprising a shell and a collapsible and expandable material disposed therein.

Yet another aspect of the invention provides a lace accessory comprising a shell, a repeatedly collapsible and expandable material disposed within said shell, a connector which affixes said lace accessory to said lace, and a removable retaining member, disposed adjacent said shell, for maintaining said lace accessory in a coiled position about the lace prior to passage through an eyelet. It should be understood that the removable retaining member is intended to maintain the lace accessory in the coiled position only temporarily.

The lace accessory can be an aglet, knot retainer, or other object which is either affixed or attached to or pendant from a lace.

The invention also provides a novelty lace having affixed thereto an aglet comprising a repeatedly collapsible and expandable foam material, a removable retaining member disposed adjacent said foam material for maintaining said aglet collapsed prior to passage through an eyelet and a connector which affixes said aglet to said lace. The aglet can further comprise a shell interposed said foam material and said removable retaining member.

The foam material can be made from a sponge, as disclosed in U.S. Pat. No. 2,952,462 to Planin, a polyurethane foam, poly(vinyl alcohol) foam, a self-skinning foam which has a substantially smooth surface low porosity outer surface as compared to its interior, or a highly compressible and collapsible urethane foam. These materials are commercially available from sources such as Tempur-Pedic (Kentucky, USA), Asia Polyurethane Mfg. Pte. Ltd. (Singapore), Foamex (Pennsylvania, USA), Rynel® (Maine, USA), Dan-Foam A/S (Denmark) and Jones & Vining, Inc. (Maine, USA). These materials can be self-expanding or expandable by means of an expanding agent such as water, solvent, heat, cold, light, fire and the like.

Other features, advantages and embodiments of the invention will be apparent to those skilled in the art by the following description, accompanying examples and appended claims.

BRIEF DESCRIPTION OF THE DRAWINGS

The following drawings are part of the present specification and are included to further demonstrate certain aspects of the invention. The invention may be better understood by reference to one or more of these drawings in combination with the detailed description of the specific embodiments presented herein.

DETAILED DESCRIPTION OF THE INVENTION

In one aspect, the invention is a repeatedly collapsible and expandable aglet for a lace comprising a shell and a collapsible and expandable material disposed within the shell. When collapsed and affixed to the end of a lace, the aglet can pass through an eyelet; therefore, there is no need for attachment of the aglet subsequent to passage through an eyelet. If necessary, the aglet can be coiled to facilitate insertion through the eyelet. The term "coiled", as used herein, refers to any operation whereby the aglet is compressed, rolled, wrapped or folded in a geometry suitable for passing through the eyelet.

The lace of the invention can be any commercially available lace and generally comprises any natural, synthetic, leather or metal fiber, cloth or combinations thereof. It can be adorned with any of a number of decorations.

Figure 1A:
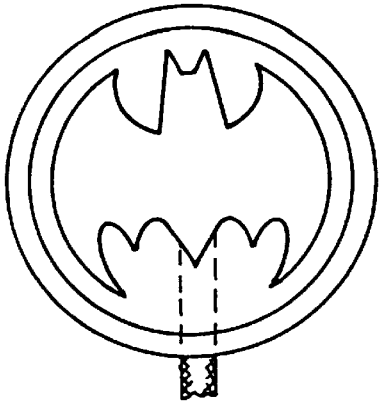
FIGS. 1*a*–1*f*—six exemplary embodiments of the collapsible and expandable aglet and lace of the invention.
Figure 1B:
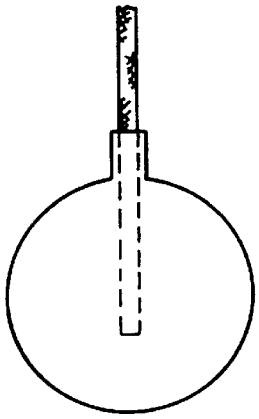
Figure 1C:
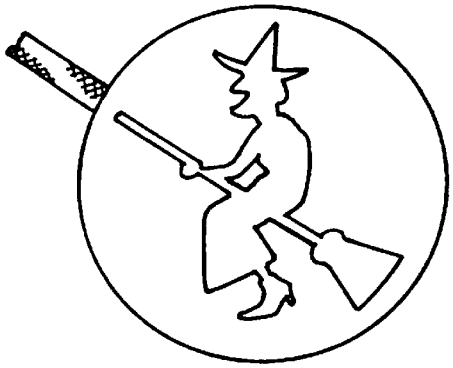
Figure 1D:
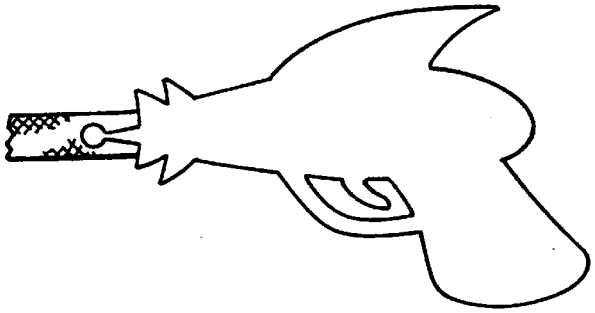
Figure 1E:
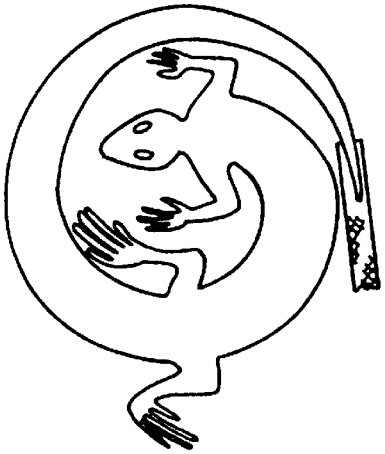
Figure 1F:
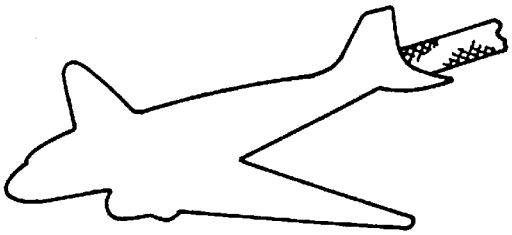

By "aglet" is meant a 2- or 3-dimensional object which is or can be attached to an end of a lace. The aglet of the invention can be in the shape of essentially any known objects including, by way of example and without limitation, buildings, people, animals (FIG. 1*e*), food, toys, weapons (FIG. 1*d*), sporting goods (FIG. 1*b*), machinery, caricatures (FIG. 1*c*), fanciful figures, logos (FIG. 1*a*), letters, spaceships, and air, land or water borne vehicles (FIG. 1*f*), and the like.

By "collapsible and expandable" is meant capable of being collapsed and expanded. By "collapsible" is meant can be collapsed from a larger, i.e., expanded, 2- or 3-dimensional object to a smaller 2- or 3-dimensional object. By "expandable" is meant capable of forming an expanded 2- or 3-dimensional object. The aglets of the invention are generally repeatedly collapsible and can be collapsed and expanded without the use of a machine.

A "collapsible and expandable material" is capable of existing in either the collapsed or expanded form. Such materials include any which will expand when treated in a first manner and collapse when treated in a second manner. The collapsible and expandable material comprises starch grafted poly(acrylic acid), a starch derivative, a cellulose derivative, foam, a superabsorbent agent, poly(vinyl alcohol), poly(alkyl amine), poly(acrylamide) amine derivative, a hydrogel, poly(acrylic acid), microbial cellulose, poly(vinyl pyrrolidone), polyurethane, polyester, polyamide, polyimide, or combinations and/or salts thereof. The collapsible and expandable material is generally porous.

The collapsible and expandable material will be collapsible with a collapsing agent and expandable with an expanding agent. In a preferred embodiment, the collapsible and expandable material will be water expandable, i.e. expandable by exposure to or treatment with water, and will be collapsible by removal of water by exposure to or treatment with a collapsing agent. By "collapsing agent" is meant any agent, chemical, condition, process or compound which will collapse a collapsible and expandable material. Collapsing agents include, by way of example and without limitation, manual compression, salt, heat, dry air, evaporation, compression, water miscible organic solvent, acetic acid, salt solution, bicarbonate or carbonate solution, alcohol, ethanol, isopropanol, combinations thereof and others known to those of skill in the art. By "water miscible" is meant can be dissolved in water or will dissolve water. By "expanding agent" is meant any agent, chemical, condition, process or compound which will expand a collapsible and expandable material. Expanding agents include, by way of example and without limitation, the inherent nature of a material to expand, water, solvent, heat, cold, light, fire, ice and combinations thereof.

In another preferred embodiment, the collapsible and expandable material will be in particulate, powdered, agglomerated, amorphous, crystalline or other solid form when collapsed. These forms are particularly advantageous as they permit the expanded material to adapt to and fill the interior cavity of an aglet comprising a shell.

In another preferred embodiments, the collapsible and expandable material is a sponge or foam which is molded in such a way that when it is expanded it forms a predetermined shape.

When collapsed and affixed to the end of a lace, the aglet of the invention is generally capable of being laced through an eyelet. However, when used as a lace accessory for attachment to a lace subsequent to lacing an article, the aglet of the invention need not fit through an eyelet when collapsed.

The aglet according to the invention is affixed to a lace by a connector which includes, by way of example and without limitation, adhesive, cement, glue, wire, string, clamp, yam, strap, rope, tape, plastic, rubber, resin, derivatized cellulose, synthetic or natural polymer, plastic or rubber that has been integrated into or onto the lace, other such materials known to those of ordinary skill in the art and combinations thereof.

When present, the shell of the aglet is intended to retain the collapsible and expandable material of the invention. The shell will be made of flexible and/or expandable materials such as, by way of example and without limitation, plastic, rubber, polymer, cloth, leather, paper, polyolefin, polyalkylene, polyester, polyamide, nylon, cotton, cellulose, polycarbonate, polyurethane, latex, poly(ethylene terephthalate), polyethylene, polypropylene, laminated paper, film or combinations thereof.

According to the properties of the collapsible and expandable material used to make an aglet, the shell can be made of a substantially water impermeable or water permeable material. By "water impermeable" is meant a material, such as plastic or rubber film, that generally does not permit diffusion of liquid water but might permit diffusion of water vapor. By "water permeable" is meant a material, such as porous plastic, rubber, paper, leather, film and cloth, that generally permits diffusion of liquid water and water vapor.

When an aglet comprises a shell made from a substantially water impermeable material and a collapsible and expandable material within the shell which is water or solvent expandable, the lace will serve as a wicking agent to draw water and/or solvent into the shell. By "wicking agent" is meant a material which will draw water from one area to another by way of capillary force. Use of a substantially water impermeable material for the shell will aid in retaining water or solvent within the shell and thus in maintaining the collapsible and expandable material expanded for an extended period of time.

When an aglet comprises a shell made from a substantially water permeable material and a collapsible and water or solvent expandable material within the shell, water or solvent can enter the shell through the lace to which the aglet is attached or through the shell itself. Use of a substantially water permeable material for the shell will permit relatively facile removal of water from the collapsible and expandable material within the shell by a collapsing agent and will permit more rapid collapse of the material.

Figure 2A:
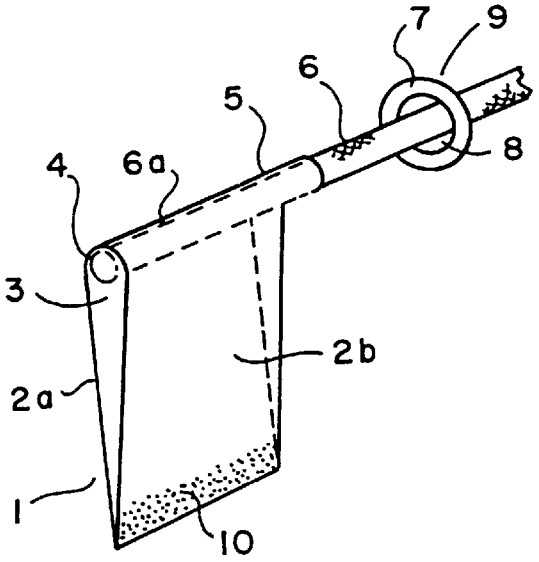
FIG. 2*a*—perspective view of a collapsed aglet embodiment and lace of the invention.

In one aspect, the aglets of the invention are generally constructed as shown in FIG. 2*a* which depicts one embodiment of collapsed aglet (1) in the shape of a flag. The aglet (1) comprises a front surface (2*b*) and a rear surface (2*a*) which together define an internal cavity (3) and are disposed about and adjacent an end (4) of a lace (6). The aglet (1) also has a cuff (5) which can substantially surround a portion of the lace (6). The cuff (5) can be any length desired. Disposed within the cavity (3) is a collapsible and expandable material (10) depicted in the collapsed form. As shown, the lace (6) has already been passed through an eyelet (9) which comprises a ring (7) defining a hole (8).

The aglet (1) is generally affixed to lace the (6) by way of an adhesive , i.e., a connector, disposed within the cuff (5) or within the cavity (3) along a portion (6*a*) of the lace (6). The collapsible and expandable material (10) is generally particulate and can be disposed anywhere within the cavity (3). The end (4) of the lace (6) can be disposed within the cavity (3) or outside of the aglet (1). When disposed outside of the aglet (1) as in FIG. 2*a*, the end (4) can also serve as a wicking agent.

The embodiment of FIG. 2*a* shows a collapsible and expandable material (10) which is water expandable but in the dehydrated (desiccated or dry) form. Here, the shell of aglet (1) comprises a substantially water impermeable material. Therefore, in order for water to enter into the cavity (3) to expand the material (10), it must do so by way of the lace (6) which serves as a wicking agent.

Figure 2B:
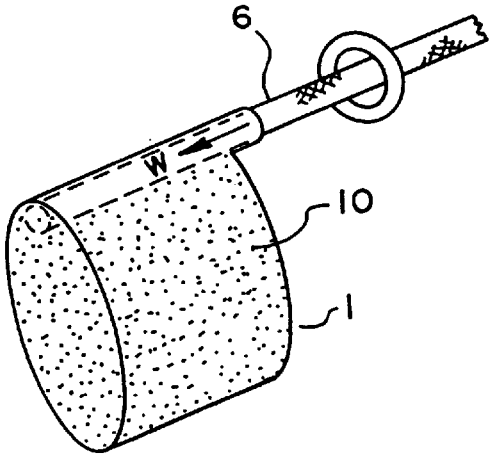
FIG. 2*b*—perspective view of an expanded aglet embodiment and lace of the invention.

When the aglet (1) and a portion of lace (6) is immersed in water, the water can pass through the cuff (5), as indicated by arrow (W), and into the cavity (3). As depicted in FIG. 2*b*, the collapsible and expandable material (10) expands to fill the cavity (3) upon exposure to water. Since the material (10) is generally particulate, it can adapt to fit and fill the cavity (3) regardless of the shape of the cavity.

The loading amount of the collapsible and expandable material (10) will depend upon the material's degree of swelling, i.e. the ratio of expanded size over collapsed size, the extent of cavity fill desired, the nature of the collapsing agent to be used, if necessary, and/or other considerations. Generally, the higher the degree of swelling, the lower the amount of material (10) needed to fill the cavity (3).

Figure 3A:
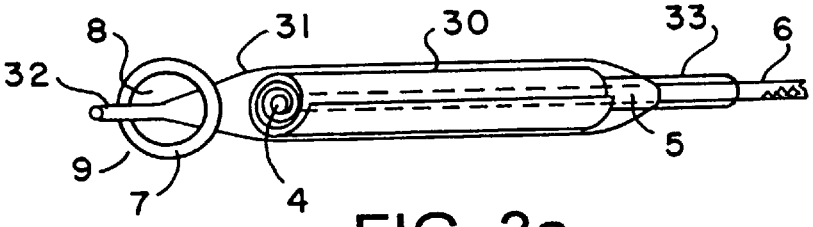
FIG. 3*a*—perspective view of a first embodiment of a collapsed, coiled and retained aglet and lace of the invention.

In order to facilitate passage through an eyelet, it may be necessary to wind, compress or coil a collapsed aglet around a respective lace. FIG. 3*a* depicts another aspect of the invention wherein a collapsed and coiled aglet (30) is generally substantially surrounded by a removable retaining member (31). The aglet (30) is coiled or wound about the lace (6) in order to minimize its size. The removable retaining member (31) generally closely surrounds the coiled aglet (30) and can have a first end (32) and a second end (33). The diameter of the retaining member (31) is sufficiently small to permit passage through a hole (8) of an eyelet (9). The first end (32), which is proximal the end (4) of the lace (6), is generally, but not necessarily, tapered and smaller in diameter than the rest of the removable retaining member (31). As depicted, the removable retaining member (31) extends the entire length of the aglet (30); however, this is not necessary. It is generally only required that the removable retaining member (31) maintain the aglet (30) in the coiled or compressed position during passage of the aglet through an eyelet.

The removable retaining member (31) can comprise cardboard, paper, wire, string, thread, film plastic, rubber, heat shrinkable or pressure sensitive material, tape, removable, water soluble, water insoluble, repositionable, temperature sensitive or low adhesive strength adhesive, chemical forces present in the collapsible and expandable foam material and combinations thereof By way of example and without limitation, the removable retaining, member (31) can be a paper sleeve, a segment of tape, a rubber film, thread, still, fiber, heat shrink tubing, ionic attraction, Van der Waals attraction, hydrophobic attraction, hydrophilic attraction, other materials known to those of ordinary skill in the art and combinations thereof.

Figure 3B:
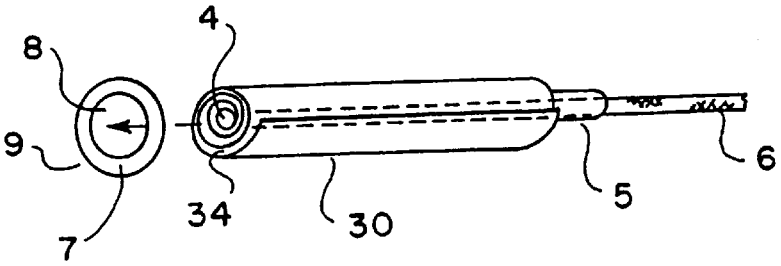
FIG. 3*b*—perspective view of a second embodiment of a collapsed, coiled and retained aglet and lace of the invention.

As depicted in FIG. 3*b*, the removable retaining member (34) can be an adhesive disposed between coiled or wound layers of the aglet (30) which maintains the aglet (30) in the coiled, collapsed or compressed position during passage of the aglet through the eyelet (9). Adhesives generally useful as removable retaining members according to the invention include, by way of example, water soluble or removable, water insoluble, repositionable, temperature sensitive, pressure sensitive and/or low adhesive strength adhesives. In a preferred embodiment, the adhesive is water soluble or removable. Thus, the retaining member (34) can be removed by placing the aglet (30) in water thereby permitting the approximately simultaneous removal or dissolution of the retaining member (34) and expansion of a water expandable material (not shown) in the aglet (30).

Figure 4:
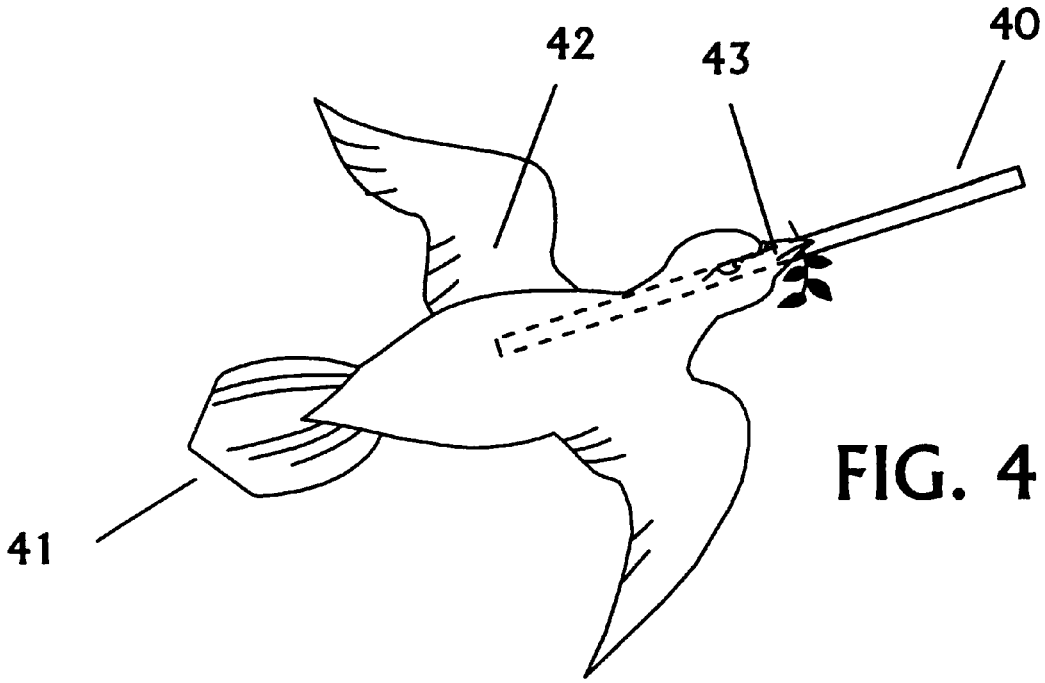
FIG. 4—perspective view of a third embodiment of the lace and aglet of the invention wherein the aglet comprises a foam material.

The novelty lace and aglet combination depicted in FIG. 4 includes a lace (40) and an aglet (41) comprising a bird-shaped repeatedly expandable and collapsible foam material (42) and a connector (43). The foam material (42), shown in expanded form, is porous and can be collapsed to fit through an eyelet of an article, such as a shoe. The connector (43) is integral with the foam material (42) and is made by molding the foam material (42) in the presence of the lace (40) such that the foam is affixed into and onto the lace(40). In another embodiment, the connector (43) is an adhesive.

Figure 5:
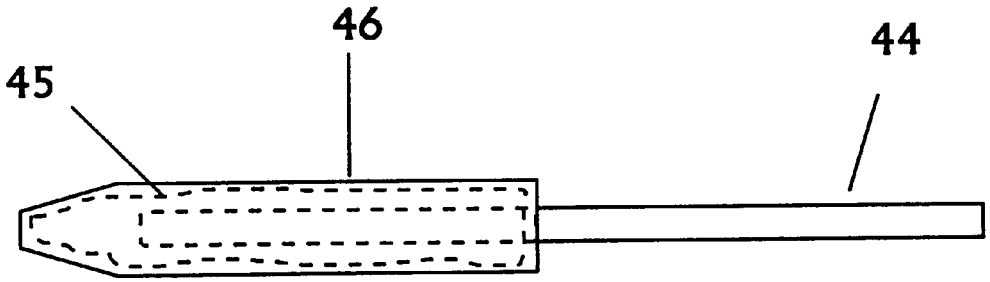
FIG. 5—top plan view of the lace and aglet of FIG. 4 wherein the aglet is collapsed and further comprises a removable retaining member.

FIG. 5 depicts the novelty lace (44) and aglet (45) combination of FIG. 4 in collapsed form where a removable retaining member (46) surrounds the aglet (45) and at least temporarily maintains it in collapsed form. In the collapsed form, the removable retaining member (46) and the aglet (45) can generally pass through an eyelet of an article. Once the aglet (45) made from foam material has been expanded, it can generally be collapsed by hand, depending upon its materials of construction, to permit passage of the aglet through an eyelet.

EXAMPLE 1

A lace having a repeatedly collapsible and expandable aglet affixed thereto was made as follows. Poly(ethylene terephthalate) film was cut and heat sealed according to the embodiment of FIG. 2*a*. A small portion of repeatedly collapsible and expandable material starch grafted polyacrylic acid (Aldrich Chemical Co., Milwaukee, Wis.) was placed within the aglet through its cuff. A first end of a commercial cotton/polyester shoelace adorned with writing and a school logo was inserted into the aglet through its cuff and attached with epoxy based adhesive. The aglet was colored with a marker to resemble a flag. It was then coiled, or wound, about the first end of the shoelace and inserted within a segment of heat shrink tubing, the retaining member. The ends of the tubing were heated to form the collapsed, coiled and retained aglet of FIG. 3*a*. After passing the retained aglet through the eyelet of a shoe, the heat shrink tubing was removed and the aglet placed in water. The lace served as a wicking agent, and after a period of time, the aglet swelled to form the configuration depicted in FIG. 2*b*. Subsequently, the aglet was allowed to dry, and, after a period of one week, the water within the aglet had evaporated and the repeatedly collapsible and expandable material had collapsed. The aglet was expanded again by treatment with water. Subsequently, the aglet was collapsed by treatment with a collapsing agent, table salt (NaCl) solution.

EXAMPLE 2

A lace having a repeatedly expandable and collapsible aglet comprising a foam material was made as follows. Precursors, monomer A and monomer B, for making flexible, porous, repeatedly collapsible and self-expanding polyurethane foam were mixed and poured into an empty bird-shaped mold. While the mixed monomers were still in liquid form, a first end of a lace was placed in the mixture. As the polyurethane foam formed it adhered to the lace and occupied the bird-shaped mold. The aglet and lace combination were then removed from the mold, and the surface of the aglet decorated with paint. The aglet was then coated with a layer of poly(vinyl alcohol) (PVA), collapsed and dried in the collapsed form. After passing the aglet and lace through an eyelet, the aglet was expanded by removing the PVA coating with water or otherwise. The aglet was repeatedly compressed by handed.

The above is a detailed description of particular embodiments of the invention. It is recognized that departures from the disclosed embodiments may be made within the scope of the invention and that obvious modifications will occur to a person skilled in the art. Those of skill in the art should, in light of the present disclosure, appreciate that many changes can be made in the specific embodiments which are disclosed herein and still obtain a like or similar result without departing from the spirit and scope of the invention. All of the embodiments disclosed and claimed herein can be made and executed without undue experimentation in light of the present disclosure.

What is claimed is:

1. A lace having affixed thereto a repeatedly collapsible and expandable aglet comprising: a repeatedly collapsible and expandable foam material and a connector for affixing said aglet to said lace, said aglet being capable of forming an expanded multi-dimensional object and of being laced through an eyelet, said aglet having a shell surrounding said foam material, said shell being substantially water impermeable material, said lace serving as a wicking agent and said foam material being water expandable.

2. The lace of claim 1, wherein said shell comprises a flexible film, plastic, rubber, polymer, leather or metallized fiber or cloth material or a combination thereof.

3. The lace of claim 1, wherein said foam material is porous and is selected from a group consisting of starch grafted poly(acrylic acid), a starch derivative, a cellulose derivative, a superabsorbent agent, poly(vinyl alcohol), poly (alkyl amine), poly(acrylamide) amine derivative, a hydrogel, poly(acrylic acid), microbial cellulose, poly(vinyl pyrrolidone), polyurethane, polycarbonate, polyalkylene, polyester, polyamide, polyimide, combinations thereof and salts thereof.

4. The lace of claim 1, wherein said foam material can be collapsed by treatment with a collapsing agent.

5. The lace of claim 4, wherein said collapsing agent comprises one or more of salt, heat, dry air, evaporation, manual compression, water miscible organic solvent, acetic acid, salt solution, bicarbonate or carbonate solution, alcohol, ethanol, isopropanol and combinations thereof.

6. The lace of claim 5, wherein the water miscible organic solvent is alcohol.

7. A repeatedly collapsible and expandable lace accessory capable of forming an expanded multi-dimensional object, said lace accessory comprising a shell, a repeatedly collapsible and expandable foam material disposed therein and a connector for affixing said lace accessory to a lace, said shell selected from the group consisting of a flexible plastic, rubber, polymer, leather, metallized fiber, cloth material and combinations thereof, said shell being substantially water impermeable material, said lace serving as a wicking agent and said foam material being water expandable.

8. The lace accessory of claim 7, wherein said connector is selected from the group consisting of adhesive, cement, glue, wire, string, clamp, yarn, strap, rope, tape, plastic, rubber, resin, derivatized cellulose, synthetic polymer, natural polymer, foam, plastic and rubber that has been integrated with the lace and combinations thereof.

9. The lace accessory of claim 7, wherein said foam material is porous and comprises one or more of starch grafted poly(acrylic acid), a starch derivative, a cellulose derivative a superabsorbent agent, poly(vinyl alcohol), poly (alkyl amine), poly(acrylamide) amine derivative, a hydrogel, poly(acrylic acid), microbial cellulose, poly(vinyl pyrrolidone), polyurethane, polyester, polyamide, polyimide, and combinations and salts thereof.

10. The lace accessory of claim 7, wherein the collapsible and expandable material can be collapsed by removal of water or treatment with a collapsing agent.

11. The lace accessory of claim 10, wherein the collapsing agent is salt, a salt-containing solution or a water miscible solvent.

12. The lace accessory of claim 11, wherein the water miscible solvent is alcohol.

13. The lace of claim 7 further comprising a removable retaining member, disposed adjacent said foam material, for temporarily maintaining said aglet collapsed, said aglet remaining attached to said lace after removal of said removable retaining member.

14. The lace of claim 13, wherein said removable retaining member comprises one or more of paper, cardboard, wire, string, thread, film, plastic, rubber, heat shrinkable or pressure sensitive material, tape, removable, water soluble, water insoluble, repositionable, temperature sensitive or low adhesive strength adhesive, chemical forces present in the collapsible and expandable foam material and combinations thereof.

15. The lace accessory of claim 7 further comprising a removable retaining member disposed adjacent said shell for temporarily maintaining said lace accessory collapsed, wherein said lace accessory can remain attached to a lace after removal of said removable retaining member.

16. The lace accessory of claim 15, wherein said removable retaining member comprises one or more of paper, cardboard, wire, string, thread, film, plastic, rubber, heat shrinkable or pressure sensitive material, tape, removable, water soluble, water insoluble. repositionable, temperature sensitive or low adhesive strength adhesive, chemical forces present in the collapsible and expandable foam material and combinations thereof.

17. An aglet comprising a shell, a repeatedly collapsible and expandable foam material disposed within said shell, a connector for affixing said aglet to an end of a lace, and a removable retaining member for at least temporarily maintaining said aglet collapsed prior to passage of said aglet through an eyelet of an article, wherein said foam material can be collapsed by treatment with a collapsing agent and wherein said aglet can remain attached to a lace after removal of said removable retaining member.

18. The aglet of claim 17, wherein said connector comprises adhesive, cement, glue, wire, string, clamp, yarn, strap, rope, tape, plastic, rubber, resin, derivatized cellulose, synthetic or natural polymer, foam, plastic or rubber that has been integrated into or onto the lace or combinations thereof.

19. The aglet of claim 17, wherein said removable retaining member comprises one or more of paper, cardboard, wire, string, thread, film, plastic, rubber, heat shrinkable or pressure sensitive material, tape, removable, water soluble, water insoluble, repositionable, temperature sensitive or low adhesive strength adhesive, chemical forces present in the collapsible and expandable foam material and combinations thereof.

20. The aglet of claim 17, wherein said foam material is porous and comprises one or more of starch grafted poly (acrylic acid), a starch derivative, a cellulose derivative, a superabsorbent agent, poly(vinyl alcohol), poly(alkyl amine), poly(acrylamide) amine derivative, a hydrogel, poly (acrylic acid), microbial cellulose, poly(vinyl pyrrolidone), polyurethane, polyester, polyamide, polyimide, and combinations and salts thereof.

21. The aglet of claim 17, wherein said shell comprises one or more of a flexible plastic, rubber, polymer, leather or metallized fiber or cloth material and combinations thereof.

22. The aglet of claim 17, wherein said collapsing agent comprises one or more of salt. heat, dry air, evaporation, manual compression, water miscible organic solvent, acetic acid, salt solution, bicarbonate or carbonate solution, alcohol, ethanol, isopropanol and combinations thereof.

* * * * *